US006442967B1

(12) United States Patent
Alsenz

(10) Patent No.: US 6,442,967 B1
(45) Date of Patent: Sep. 3, 2002

(54) REFRIGERATION SYSTEM WITH COAXIAL SUCTION AND LIQUID TUBING

(75) Inventor: Richard H. Alsenz, Houston, TX (US)

(73) Assignee: Altech Controls Corporation, Missouri City, TX (US)

( * ) Notice: Subject to any disclaimer, the term of this patent is extended or adjusted under 35 U.S.C. 154(b) by 0 days.

(21) Appl. No.: 09/974,291

(22) Filed: Oct. 10, 2001

(51) Int. Cl.[7] ..... F25B 41/00; F25B 1/00
(52) U.S. Cl. ..... 62/513; 62/113; 62/498
(58) Field of Search ..... 62/513, 113, 498

*Primary Examiner*—William C. Doerrler
*Assistant Examiner*—Filip Zec

(57) ABSTRACT

A refrigeration piping process comprising the steps of installing a smaller liquid tube for supplying liquid to a remotely located evaporator, inside of a larger suction tube to be used for supplying the suction vapor from a remotely located evaporator, connecting the smaller liquid tube for supplying liquid to an evaporator to the liquid supply source at the liquid source, connecting the smaller liquid tube for supplying liquid to an evaporator to the liquid tube which supplies the evaporator and connecting the one end of the larger suction tube to a compressor and the other end of the larger suction tube to the outlet of the remotely located evaporator.

3 Claims, 3 Drawing Sheets

REFRIGERATION SYSTEM WITH COAXIAL SUCTION AND LIQUID TUBING

BACKGROUND OF THE INVENTION

1. Field of the Invention

This invention pertains to a method of connecting the liquid and suction tubes on a refrigeration system which has the evaporator located remotely from the condenser such that the liquid tube is enclosed inside of the suction tube.

2. Description of the Related Art

Refrigeration systems which have the evaporators located remotely from the compressor and condenser have the liquid and suction tubes piped separately to the evaporators. In some systems, which have several evaporators located in different locations, the liquid and suction tubes are run individually to the evaporating units. In other instances the liquid and vapor tubes are connected tree fashion, i.e., they branch off from main liquid and vapor trunks. In both instances, multiple tubes are plumbed requiring significant labor and materials costs.

The cost of connecting the remote evaporators for a typical supermarket can exceed $100,000. The installations require the skill of journeymen pipe fitters and welders. The welding/brazing of the tubing (usually copper) also causes oxidation of the inside of the tubes, which is undesirable. To prevent this oxidation, an installer is required to purge nitrogen gas through the system while welding the tubes adding further cost to the installation. Reduction of the number of tubes, and resultant welds/brazes to be made is therefore of interest.

For systems in which the liquid tubes are sub-cooled, the liquid tubes require insulation to prevent condensation and energy loss, again adding cost.

Refrigerant loss is also a major problem in refrigeration and air conditioning systems. The loss of refrigerant in a liquid tube represents a potential of larger leakage than in the suction tube because of the more than 100 times higher density of the refrigerant in the liquid tube than in the suction tube. Such refrigerant loss due to leakage can be costly, and reducing the number of tubes as well as the number of welds/brazes (often the point of leakage) would be beneficial in reducing costs. The loss of refrigerant into the atmosphere has also become a significant problem to the extent that local municipalities have enacted laws governing the control and safety issues of refrigerants.

Finally cooling the liquid in the liquid tube can improve system efficiency. Therefore, if the liquid tube were installed inside the suction tube (which contains cool vapor) it would be cooled, and the cost of operation could be reduced. The current invention goes beyond the teaching in U.S. Pat. No. 4,147,937 which discloses enclosing only the capillary tube of refrigeration system for the purpose of sub-cooling by installing the entire liquid line within the suction line to achieve the further objectives and benefits described herein.

The current invention is therefore, a design for connecting liquid and suction tubes from a compressor(s) to an evaporator(s) by installing the liquid tube(s) inside the suction tube(s), thereby simplifying installation, cooling the liquid tube, and minimizing the deleterious aspect of leaks in the liquid tube by containing any such leaks in the liquid tube to inside the suction tube and not to the atmosphere.

THIS INVENTION ACHIEVES THE FOLLOWING SYNERGISTIC OBJECTIVES

One of the objectives of the current invention is to reduce the probability of a leak occurring in the liquid tube(s).

Another objective of the current invention is to prevent a refrigerant leak to the atmosphere if a leak occurs in the liquid tube(s).

Another objective of this invention is to reduce the cost of a piping installation by eliminating the insulation on a liquid tube(s).

Another objective of this invention is to reduce the cost of a piping installation by eliminating the need to mount the liquid tube(s) to a structure.

Another objective of this invention is to reduce the cost of a piping installation by eliminating the need to us e high pressure rated tubing for the liquid tube when the liquid line pressure is reduced.

Another objective of this invention is to further sub-cool liquid arriving at the expansion valve.

Another objective of this invention is to boil liquid returning in the suction tube so as to prevent damage to the compressor.

BRIEF DESCRIPTION OF THE DRAWING FIGURES

SUMMARY OF THE INVENTION

The current invention is a method of piping a refrigeration system which has remotely located evaporator(s). The method consists of placing the liquid tube which is not the expansion device in a coaxial position with the suction tube, i.e., the liquid tube is located inside the suction tube. The installation is done similar to that of an electrician pulling an electrical cable through a conduit. The inner liquid tube is pulled through the outer suction tube. The inner tube has the advantage of not being able to leak to the atmosphere and does not have to be insulated when it is at a temperature different than the ambient, as would be the case if the liquid was sub-cooled. The liquid tube also provides for heating up any liquid which is present in the suction tube as well as the sub-cooling of the liquid by the returning low temperature suction vapor. This aids in preventing liquid from coming back to the compressor through the suction tube by causing the liquid to further boil.

Several other advantages result from this method of liquid tube hook up. The cost of installation is less because insulation does not have to be added to the liquid tube, and the liquid tube can be made of less expensive materials that may be used. In the case where the liquid tube pressure has been reduced during the entire operating cycle, liquid tubing with lower pressure ratings may be utilized inside the suction tubing.

DESCRIPTION OF THE PREFERRED EMBODIMENTS

Figure 1:
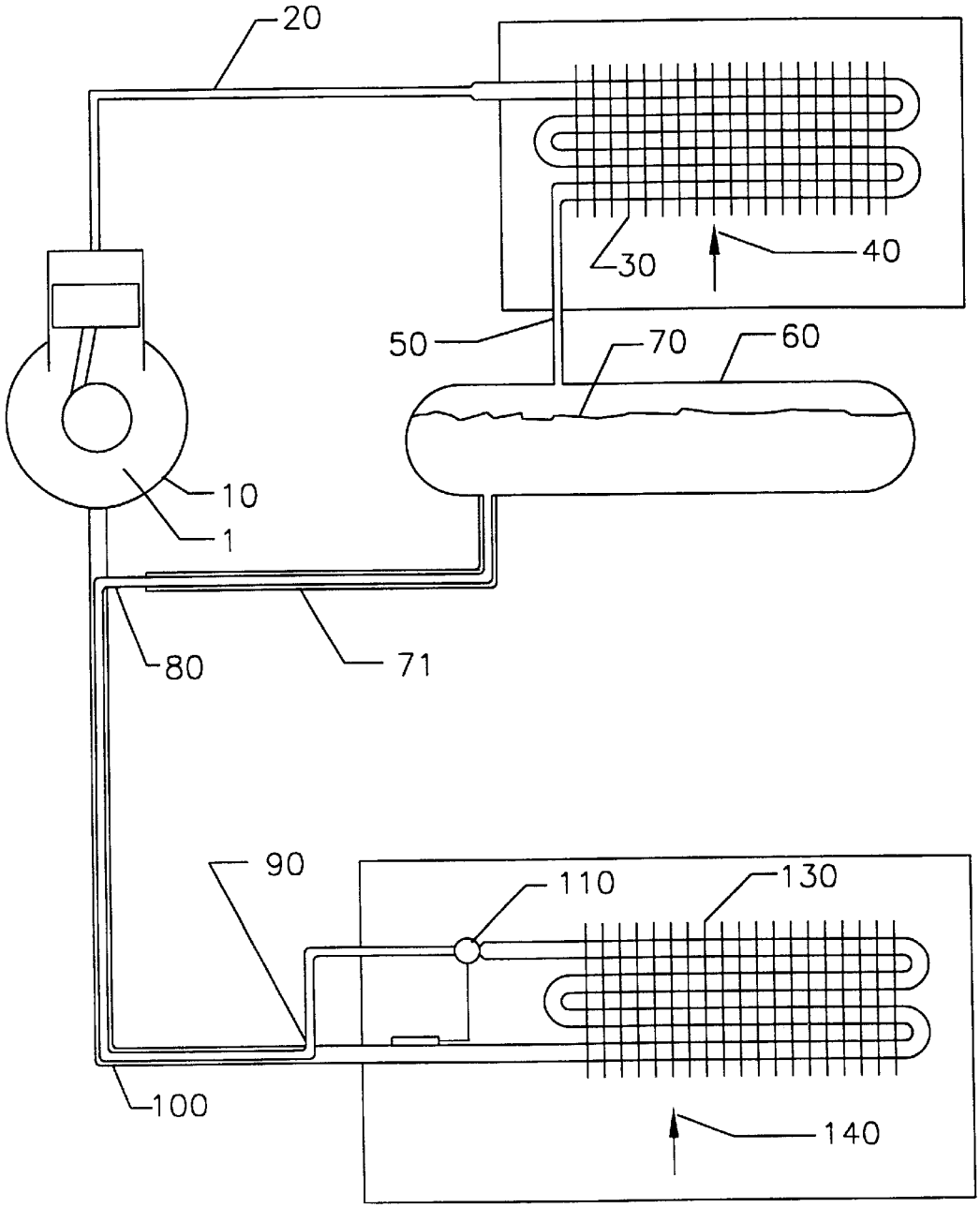
FIG. 1 is a schematic of refrigeration system utilizing the current invention of coaxial suction and liquid tube tubing in a single evaporator system.

FIG. 1 is a schematic of a refrigeration system operating with a single evaporator which utilizes one embodiment of the current invention. Compressor 10 compresses low pressure refrigerant vapor 1 to a high pressure and temperature vapor which is transported by the discharge tube to condenser 30. Ambient air 40 is blown across condenser 30 to condense the refrigerant 1 to a liquid. The liquid refrigerant condensate 1 is transported to a refrigerant receiver 60 through tube 50. The refrigerant liquid 1 is transported through tube 71 which is within suction tube 100. Liquid tube 71 transitions into suction tube 100 through transition fitting 80 and out of suction tube 100 through transition fitting 90. Refrigerant 1 is metered through expansion valve 110 to evaporator coil 130 where it is heated by refrigerated air stream 140, and is boiled to a vapor. The vapor refrigerant 1 is transmitted by suction tube 100 to compressor 10 where the cycle starts over.

Figure 2:
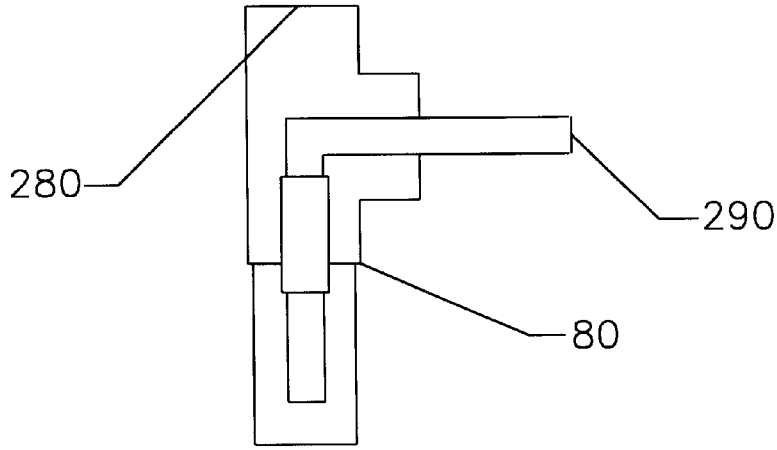
FIG. 2 is a drawing of a transition fitting used to transition the liquid tube inside the suction tube.

FIG. 2 is a drawing of a transition fitting used to transition the liquid tube inside the suction tube. The suction tube 100 in FIG. 1 is hooked up to inlet fitting 280, and liquid tube 71 in FIG. 1 is hooked up to tube 290.

Figure 3:
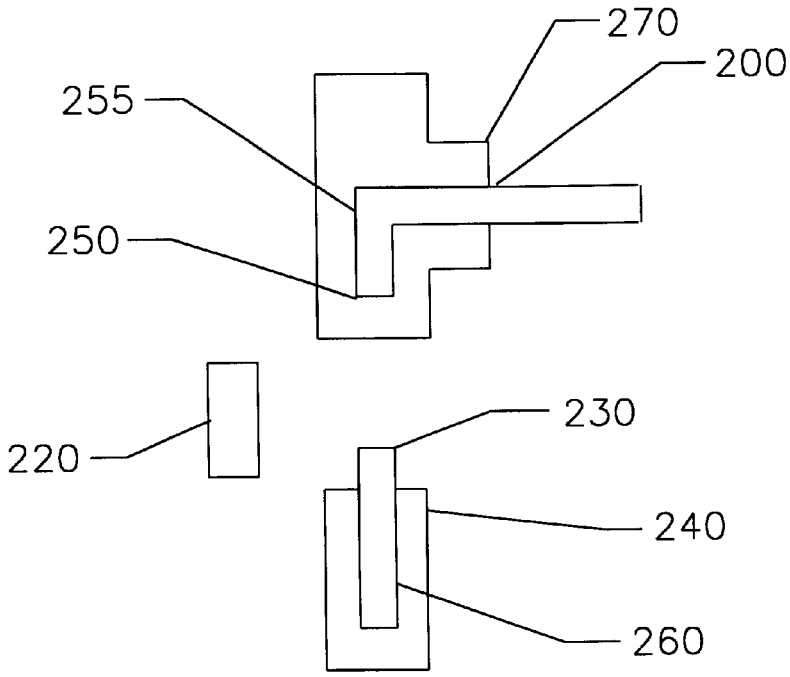
FIG. 3 is a drawing of a refrigeration system utilizing the invention in a branch piping system.

FIG. 3 is an assembly drawing of transition fitting 80. A coupling 220 is used to interconnect elbow 250 and tube 260. Tube 240 is connected to Tee fitting 270 which is secured from leaking to the atmosphere to tube 200. Any method of bonding in a way to prevent leaks between the tubings and atmosphere may be used. One method would be an epoxy-bonding compound applied on the inner surfaces of 220 and the outer surface of liquid tubings 250 and 230 and inner surface of fitting 270 and outer surface of tube 240 prior to being fitted together. Another may be welding/brazing, while another is a compression fitting. The preferred method of bonding would be epoxy which eliminates the need to provide an inert gas such as nitrogen in the tubes during the welding/brazing process.

Figure 4:
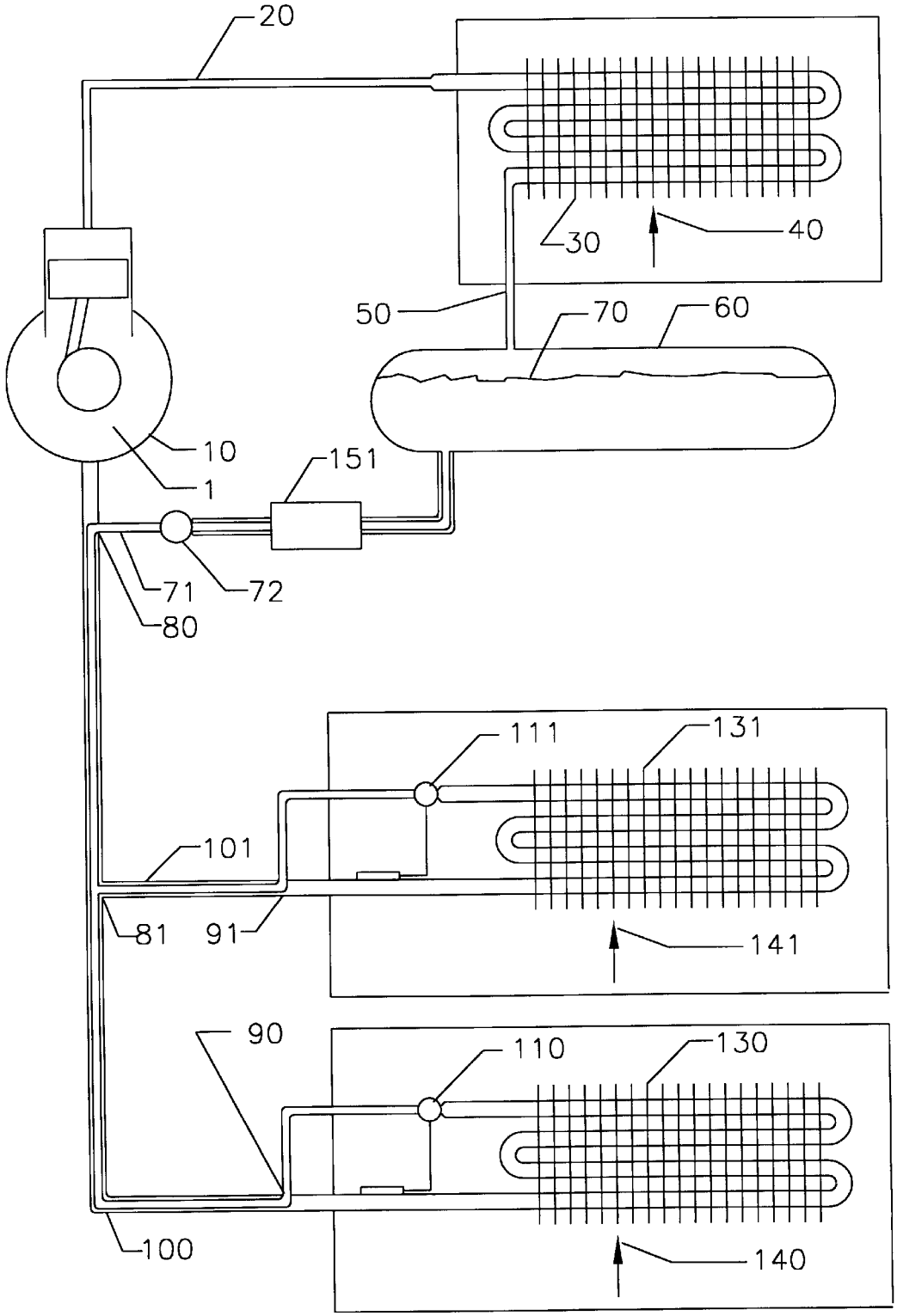
FIG. 4 is a schematic of a refrigeration system operating with multiple evaporators and mechanical liquid sub-cooling and pressure reducing valve.

FIG. 4 is a schematic of a refrigeration system operating with multiple evaporators and mechanical sub-cooling, which utilizes another embodiment of the current invention. Liquid leaving the receiver 60 is sub-cooled by sub-cooler 151. Liquid pressure is reduced with pressure reducing valve 72 and then enters the liquid tube 71 that is routed into suction tube 100 through transition fitting 80 and out of suction tube 100 through transition fitting 90. The reduction in liquid line pressure allows for a tubing of lower burst pressure rating such as nylon to be used. This results in a lower installation cost due to the ease of pulling the nylon tubing through another tube. Refrigerant 1 is metered through expansion valve 110 to evaporator coil 130 where it is heated by refrigerated air stream 140, and is boiled to a vapor. The vapor refrigerant 1 is transmitted by suction tube 100 to compressor 10 where the cycle starts over. Similarly, liquid tube 71 transitions into suction tube 101 through transition fitting 81 and out of suction tube 101 through transition fitting 91. Refrigerant 1 is metered through expansion valve 111 to evaporator coil 131 where it is heated by refrigerated air stream 141, and is boiled to a vapor. The vapor refrigerant 1 is transmitted by suction tube 101 to compressor 10 where the cycle starts over.

It should be obvious to someone skilled in the art that many different methods of connecting the fittings could be practiced and are intended to be within the scope of this patent. It should also be obvious to someone skilled in the art that many different methods expanding the refrigerant are possible including cap tubes and are intended to be within the scope of this patent. The scope of the patent is not intended to cover enclosing the expansion device in the suction line, but is intended to cover enclosing the liquid line if a cap tube is used and the liquid line is enclosed whether the cap tube is enclosed or not.

What is claimed is:

1. A refrigeration piping process comprising the steps of:

installing a smaller liquid tube for supplying liquid to an expansion device inside a larger suction tube to be used for supplying the suction vapor from an evaporator supplied by the expansion device, connecting the smaller liquid tube for supplying liquid to an evaporator to the liquid supply source at the liquid source, connecting the smaller liquid tube for supplying liquid to an evaporator to the liquid tube which connects to the expansion device.

2. A closed loop refrigeration system comprising:

A hermetically contained refrigerant,

A refrigeration evaporator for evaporating refrigerant,

A refrigeration compressor for compressing the refrigerant,

A refrigeration expansion device for metering the evaporating refrigerant,

A refrigeration suction tube for transporting refrigerant vapor from the evaporator to the compressor and for containing a liquid tube for minimizing the amount of liquid lost to the atmosphere as well as for subcooling the liquid, A refrigeration condenser for condensing the refrigerant to a liquid, A refrigeration discharge tube for transmitting the refrigerant between the compressor and the condenser, A liquid receiver for containing liquid condensate, A condenser liquid return tube for transmitting the refrigerant from the condenser to the receiver and A refrigerant liquid line inside the suction tube for transporting liquid inside the suction tube from the receiver to the expansion device.

3. A refrigeration piping process comprising the steps of:

installing a pressure reducing valve to supply lower pressure liquid in the liquid line and installing a smaller liquid tube for supplying lower pressure liquid to an expansion device inside a larger suction tube to be used for supplying the suction vapor from an evaporator supplied by the expansion device, connecting the smaller liquid tube for supplying liquid to an evaporator to the liquid supply source at the liquid source, connecting the smaller liquid tube for supplying liquid to an evaporator to the liquid tube which connects to the expansion device.

* * * * *